United States Patent [19]

Richardson

[11] Patent Number: 4,773,399

[45] Date of Patent: Sep. 27, 1988

[54] EXERCISING DEVICE

[76] Inventor: Ken O. Richardson, 15503 San Ardo Cir., La Mirada, Calif. 90638

[21] Appl. No.: 364,990

[22] Filed: Apr. 2, 1982

[51] Int. Cl.[4] ..... A61H 1/02

[52] U.S. Cl. ..... 128/25 R; 272/73

[58] Field of Search ..... 128/25 R, 25 B; 272/72, 272/73, 900

[56] References Cited

U.S. PATENT DOCUMENTS

| | | | |
|---|---|---|---|
| 1,409,992 | 3/1922 | Armstrong | 272/73 |
| 2,261,355 | 11/1941 | Flynn | 128/25 R |
| 2,453,771 | 11/1948 | White et al. | 128/25 R |
| 2,735,422 | 2/1956 | Jones | 128/25 R |
| 2,969,060 | 1/1961 | Swanda et al. | 128/25 R |
| 3,112,108 | 11/1963 | Hanke | 262/72 X |
| 3,213,852 | 10/1965 | Zent | 128/25 R |
| 3,570,477 | 3/1971 | Scriuner | 272/73 |
| 4,402,502 | 9/1983 | Peters | 272/73 |

*Primary Examiner*—Richard J. Apley
*Assistant Examiner*—J. Welsh
*Attorney, Agent, or Firm*—Edgar W. Averill, Jr.

[57] ABSTRACT

A device for exercising the arms and legs of a person who has difficulty moving these limbs. The exerciser has a platform to which right and left arm exercising members are connected. Also connected to the platform is a drive shaft to which a pair of leg exercising members are affixed. The leg and arm exercising members are linked together and the device is driven by an adjustable motor to exercise the user.

5 Claims, 1 Drawing Sheet

EXERCISING DEVICE

BACKGROUND OF THE DISCLOSURE

The field of the invention is exercising devices, and the invention relates more particularly to devices for exercising paraplegics and other persons whose limbs cannot be exercised simply by voluntary extension or contraction.

For many serious spinal injuries, a paralysis of the limbs results and it becomes necessary for the comfort of the patient to have a therapist manually extend the limbs a number of times a day to prevent the joints from becoming stiffened and painful. In the past, this has typically been carried out by hand and thus greatly added to the cost of care if done by a professional therapist or was otherwise time consuming. Furthermore, the exercise time required for patient comfort often exceeded the strength of the volunteer.

SUMMARY OF THE INVENTION

It is thus an object of the present invention to provide an exercising device for exercising the arms and legs of a person who has difficulty in moving these limbs.

The present invention is for an exercising device comprising a base platform to which right and left arm exercising members are pivotally connected at their lower ends. Each of the arm exercising members has a handle. Right and left leg exercising members are affixed to a driven shaft which is supported by the base member. The driven shaft has two generally U-shaped bends formed therein to which the leg exercising members are connected. The bends are positioned at 180 degrees apart from one another. Link members are affixed at one end to the arm exercising members and at the other end to a second pair of U-shaped bends formed in the driven shaft. Motor means are connected to the driven shaft to rotate the shaft about its longitudinal axis whereby the arm and leg exercising members are oscillated.

DESCRIPTION OF THE PREFERRED EMBODIMENTS

Figure 1:
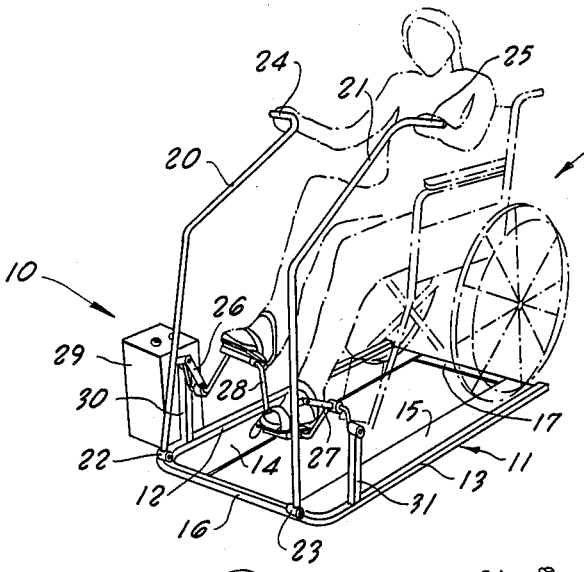
FIG. 1 is a perspective view of the exercising device of the present invention.
Figure 2:
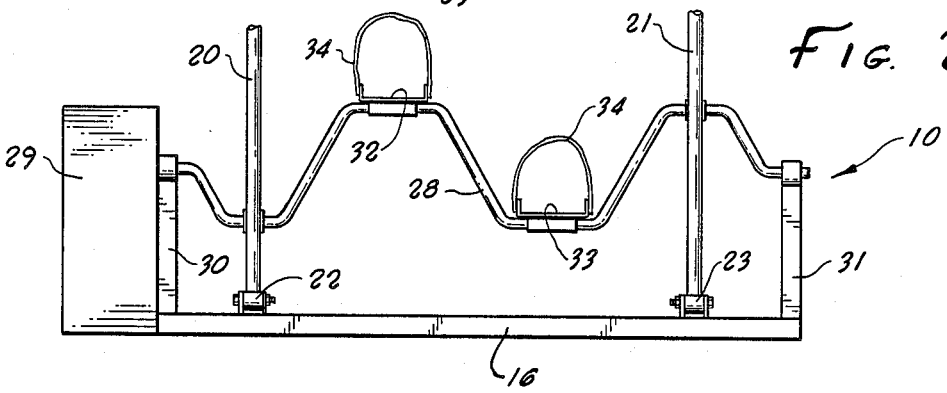
FIG. 2 is an enlarged front view of the lower portion of the exercising member of FIG. 1.
Figure 3:
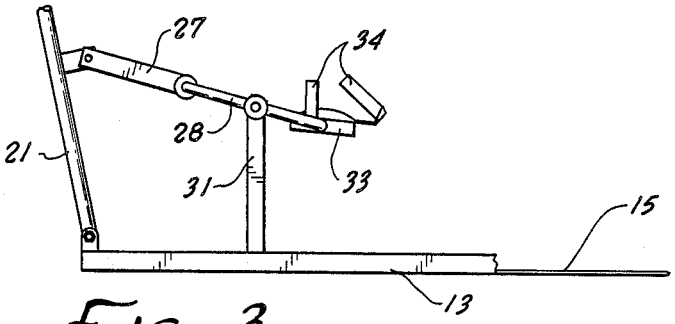
FIG. 3 is a side elevational view partly cut away of the lower portion of the device of FIG. 1.

The exercising device of FIG. 1 is indicated generally by reference character 10. Device 10 has a platform 11 which is made up of a pair of side rails 12 and 13, a pair of wheelchair platforms 14 and 15, a front rail 16 and a back rail 17.

A wheelchair 18 rests on platforms 14 and 15 and may be positioned at a comfortable location and locked in place by a brake on the wheelchair. Wheelchair 18 may be replaced by any type of chair, stool or bench. The patient in the wheelchair is then able to be strapped into the exercising device.

A pair of arm exercising members 20 and 21 are pivotally connected at 22 and 23 to front rail 16. A pair of handles 24 and 25 are located at the upper extremity of members 20 and 21.

Arm exercising members 20 and 21 are caused to oscillate by movement transmitted by a pair of links 26 and 27 which are connected between the members and a driven shaft 28. Driven shaft 28 is turned by motor 29 and shaft 28 is supported on support rods 30 and 31 which are connected to side rails 12 and 13 respectively.

A pair of foot clamps 32 and 33 are rotatingly connected to the base of a pair of U-shaped bends formed in driven shaft 28. A pair of straps indicated by reference character 34 hold the patient's foot comfortably yet securely in the clamps.

Links 26 and 27 are connected to the base of a second pair of U-shaped bends in driven shaft 28. Both pairs of U-shaped bends are positioned at 180 degree locations with respect to one another. The speed of motor 29 may be adjusted for the comfort of the user.

In use, the wheelchair is driven onto the platforms as shown in FIG. 1, and the distance of the wheelchair from the front of the device helps determine the extent of the maximum extension of the limbs. In this way, the same machine can be used by a number of different patients without adjustment merely by different placement of the wheelchair on the platform. As can be understood from FIG. 1, the patient's feet are moved in a circular movement and the patient's arms are moved esentially back and forth (although strictly speaking they are moved through a part of a large arc). This combination of movements, when the wheelchair is positioned so that the legs are almost straightened at the maximum extension results in a turning of the shoulders and hips providing a particularly useful exercise for the trunk.

The patient's feet are strapped into the foot clamps 32 and 33, and the patient's hands are placed on handles 24 and 25. The motor is then started at a slow speed to ascertain patient comfort, and the speed is increased to the desired degree.

It has been found that patient comfort is greatly improved by the use of the device of the present invention. In one instance when the machine was out of service for about one week, the patient exhibited considerable pain which was relieved when the machine was again operative.

It is believed that the exercising device of the present invention provides an important method to improve patient mobility and comfort while still being relatively inexpensive and easy to operate. It may be maintained either in the home or in a treatment facility.

It is possible that hand holding straps could be added for those patients who would be unable to maintain contact with handles 24 and 25, and remote control switches operated by, for instance, the patient's head are also within the spirit of the present invention.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

I claim:

1. A device for passively exercising the arms and legs of a person who has difficulty moving these limbs, said device comprising:

a base platform;

right and left arm exercising members, each comprising an elongated shaft, pivotally connected to the base platform at the bottom of each shaft, each of said arm exercising members having handles;

right and left leg exercising members affixed to a driven shaft, said driven shaft having a first pair of generally U-shaped bends formed therein, said first pair of bends being foot supporting bends, each bend including a base, said bends being positioned at 180 degrees from one another and said driven shaft being supported by said base platform, said leg exercising members having foot attachment means rotatingly affixed thereto at the base of said U-shaped foot supporting bends;

link members hingedly affixed between said arm exercising members at a point removed from their point of pivotal connection to said base platform and a second pair of opposed U-shaped arm oscillating bends formed in said driven shaft and pivotally connected at the base of said arm oscillating bends, the base of said second pair of U-shaped bends being oriented at about 180 degrees from each other so that the arms and legs of the user are moved in a predetermined, unison movement; and motor means connected to said driven shaft to rotate said shaft about its longitudinal axis, whereby said arm and leg exercising members are oscillated thereby exercising the user.

2. The device of claim 1 wherein the platform is shaped to permit a wheelchair to rest thereon.

3. The device of claim 1 further including foot holding means attached to the right and left leg exercising members.

4. The device of claim 1 wherein said motor means is a variable speed motor.

5. The device of claim 1 wherein the right and left arm exercising members are both pivotally connected to said base platform in front of said driven shaft whereby the resulting arm movement is such so that when one of a user's arms is extended, the other of a user's arms is contracted.

* * * * *